United States Patent [19]

Bel

[11] Patent Number: 4,655,153

[45] Date of Patent: Apr. 7, 1987

[54] PORTABLE STANCHION FOR SHIPS

[76] Inventor: Ronald Bel, Local 920 ILA, 514 Bay St., Staten Island, N.Y. 10304

[21] Appl. No.: 716,558

[22] Filed: Mar. 27, 1985

[51] Int. Cl.[4] ..... B63B 25/28

[52] U.S. Cl. ..... 114/75; 410/82; 410/94

[58] Field of Search ..... 114/75, 364, 218; 105/380, 382, 384; 410/94, 95, 82

[56] References Cited

U.S. PATENT DOCUMENTS

| | | | |
|---|---|---|---|
| 3,494,301 | 2/1970 | Sause, Jr. | 105/382 X |
| 3,950,803 | 4/1976 | Reynolds et al. | 114/364 |
| 4,082,052 | 4/1978 | Looks | 410/82 |

*Primary Examiner*—Sherman D. Basinger
*Attorney, Agent, or Firm*—Peter L. Berger

[57] ABSTRACT

A portable stanchion for containerized ships is set forth. The portable stanchion includes a vertical post which is attached to a lock shoe, and the vertical post contains rings through which ropes may be passed. The portable stanchion may be locked in position to the ship's deck by operating a foot lever, and it may be removed therefrom by operating the foot lever and lifting the stanchion from the holes formed within the ships deck to which the stanchions may be attached. Ropes may be passed between the stanchions in order to further enhance the safety provided by the Bel stanchion.

3 Claims, 4 Drawing Figures

FIG. 1
PRIOR ART
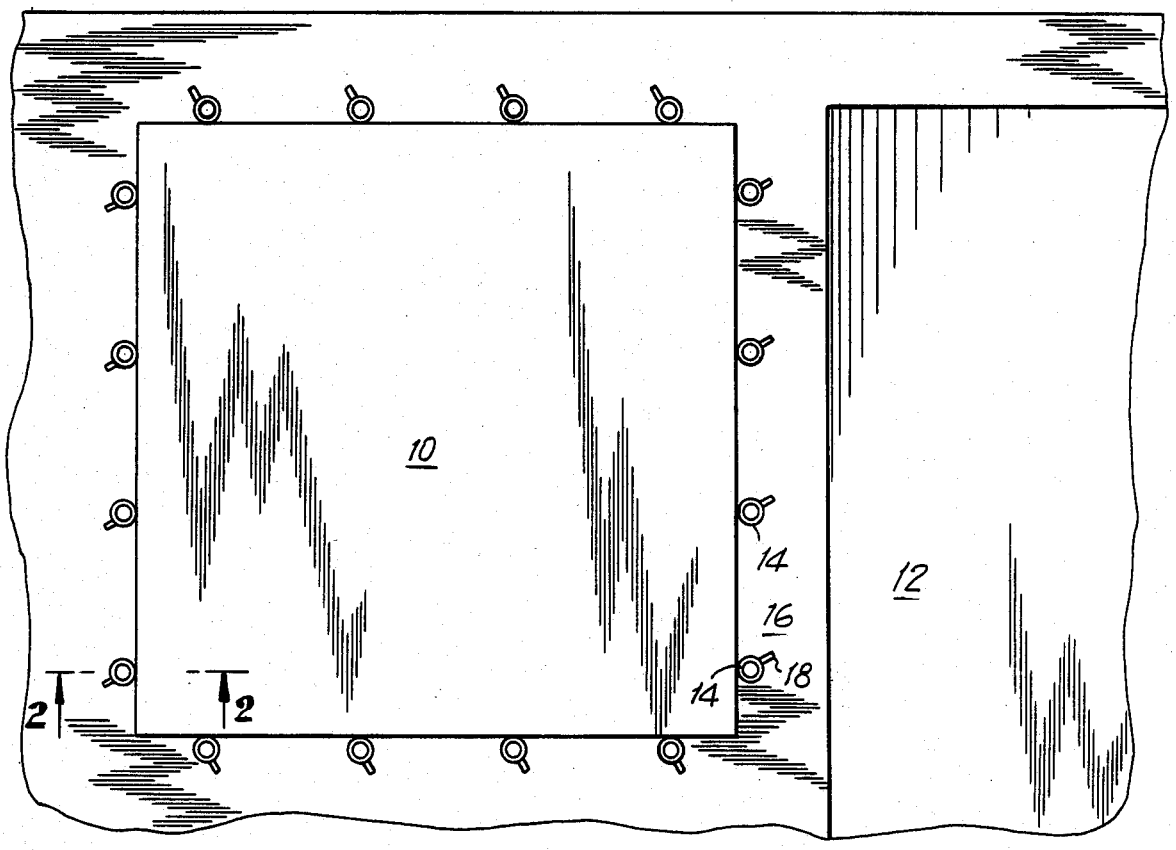
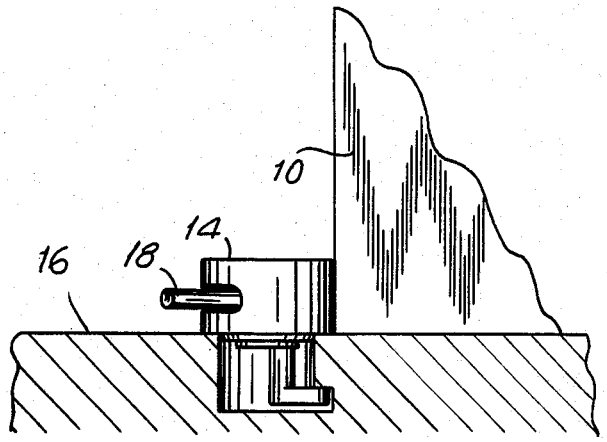
FIG. 2
PRIOR ART

PORTABLE STANCHION FOR SHIPS

BACKGROUND OF THE INVENTION

This invention relates to a portable stanchion for use on ship decks, and more particularly, to such a portable stanchion for use with general standard container type ships.

Standard container ships are used for transporting standardized containers which are loaded onto ship decks. They may be loaded onto the deck itself or into recesses formed within various levels of the ships decks. Workers generally are moving around on the deck, and they assist in thc various crane operators in positioning the containers on the deck to be properly stored during transportation. A lock shoe is widely employed which fits into holes cut into the deck and contains a lip which locks onto the container and locks the container to the ship deck. This lip is operated by a foot lever, and this foot lever and lock shoe arrangement is utilized as part of the present invention.

Workers moving about the deck of such ships sometimes lose balance and can fall and be injured. Due to the large number of open hatches found within various ship decks, it would be desirable to provide means for the workers to grab onto some support to prevent their inadvertent falling and injury. At present, no stanchions are provided on ship decks in which standard container loads are utilized, and a perilous work situation is created.

An object of this invention is to provide an improved safety device for use on containerized ships which will allow the workers to be able to find quick support should they lose balance while working.

Another object of this invention is to provide such a support which may be widely employed and uses standard fairly conventional techniques in its assembly construction and operation.

Yet another object of this invention is to provide such a portable stanchion which may be conveniently locked in place and can be easily removed from its locked position without interfering with the operation of the containerized ships.

Another object of this invention is to provide such a portable stanchion which includes loops through which ropes may be passed in order to further enhance the support provided by the portable stanchion.

Yet another object of this invention is to provide such a portable stanchion which may be readily moved from place to place on board.

Still another object of this invention is to provide such a safety device which may be readily understood and capable of easy operation so that it may be widely adopted and used throughout the maritime industry.

Other objects, advantages and features of this invention will become more apparent from the following description.

SUMMARY OF THE INVENTION

In accordance with the features of this invention, I have invented the Bel stanchion which may be widely employed to enhance safety for workers aboard standardized containerized ships. Specifically, I use a standard lock shoe which is employed with containers to hold the containers in place, and I have provided a post or stanchion which is welded or secured to the lock shoe. In one arrangement, the entire assembly may be made as a single integral unit, and I provide the stanchion post to be of sufficient height to be able to carry ropes between stanchion locations. In accordance with the principles of this invention, my portable stanchion allows utilization of already provided holes in the decks of the container ships, and the utilization of the portable stanchion is easily understood because of the workers familiarity with the lock shoes presently employed. The stanchion is made of metal and is rigid, and with several stanchions in place on a ship's deck, a rope may be passed between the posts. In this manner, the portable stanchion may be in place while workers are moving about on a ship's deck, and these stanchions or the rings and the ropes which are attached thereto may be quickly grasped by the workers. When it is necessary to load containers in the vicinity of the portable stanchions, the stanchions may be removed to provide a clearer flat open deck space. On the other hand, the stanchions may be kept in place, until such time as that area is required for clearance in order to load containers thereon.

The portable stanchion may be at least 4 feet in height, so that it may be quickly and easily grabbed by a worker who may be losing balance. Due to the relatively simple nature of the invention, it is expected that this significant safety improvement will find widespread use throughout the maritime industry.

BRIEF DESCRIPTION OF THE DRAWING

FIG. 1 is a top plan view of a portion of a containerized ship showing a container location and an open hatch next to the container location.

FIG. 2 is a sectional view along the lines 2—2 of FIG. 1 showing the prior art container and locking shoe arrangement which locks the container to the deck of the ship.

Figure 3:
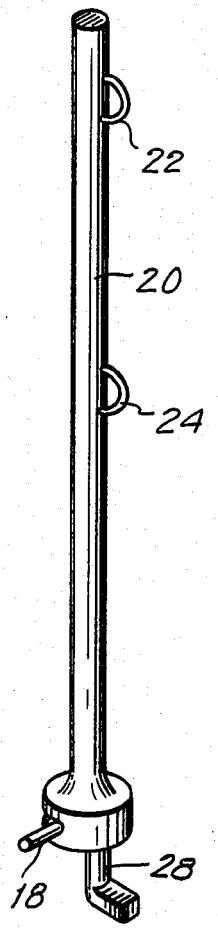
FIG. 3 is a perspective view of the portable stanchion of this invention showing the rings attached thereto.

The stanchions may also be used on top of the containers themselves in the event that a container is damaged while being hoisted on or off of the ship making it necessary for the workers to go on top of the container; as there are holes on top of all containers where the safety stanchions may be secured.

DETAILED DESCRIPTION

In accordance with this invention, a portable stanchion known as the Bel stanchion is provided. My invention is suitable for use on containerized ships, and FIG. 1 presents a top plan view of a portion of the deck of a ship showing a container 10 and an open hatch portion 12. The container 10 is fixedly held in place by means of lock shoes 14 which grab the container and hold it to the deck 16 of the ship. These lock shoes are operated by manually kicking a lever 18 and the lever will lock the container to the deck in one position, and in the other position, the lock shoe can be removed from the deck allowing the container to also be removed.

In accordance with the principles of this invention, I employ the standard lock shoe described above, but attach thereto a cylindrical rod 20 which extends at least 4 feet above the deck. The rod has securely and integrally formed therewith rope rings 22 and 24, and the entire assembly is rigid which enhances its safety features when it needs to be grabbed by a worker who is losing his balance. Obviously, the use of the stanchions is not limited solely to workers losing their balance, and the mere mental security which would be found by having the portable stanchions available will also enhance the safety for workers working on containerized ships.

Figure 4:
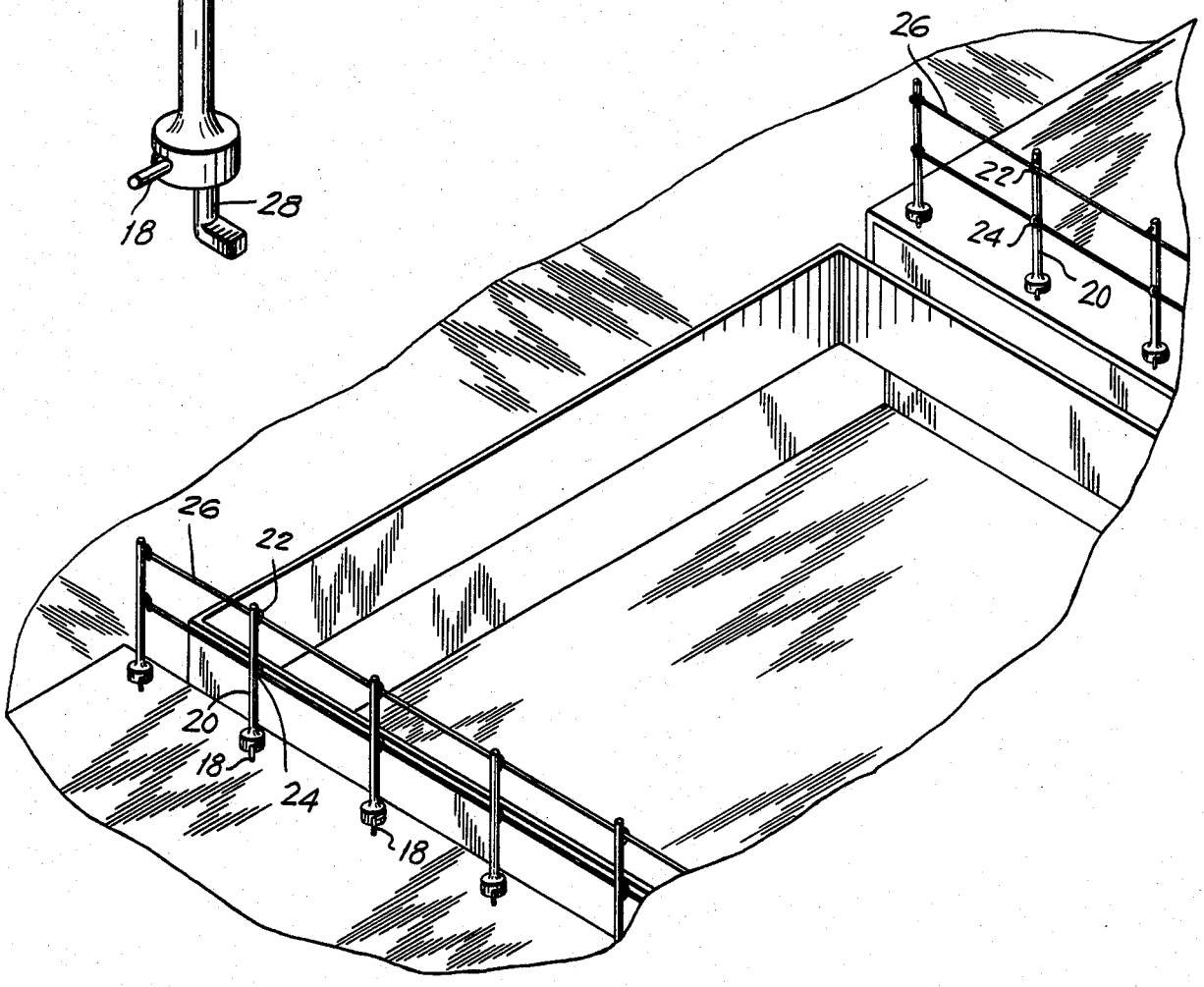
FIG. 4 is a top perspective view showing the stanchions in place with rope therebetween allowing for enhanced safety.

FIG. 4 is a top perspective view showing the Bel stanchions in place. Rope 26 is connected between the rope rings 22 and 24, and the rope further enhances the safety feature of the present invention by providing a grabbing surface between the stanchions. By using the standard lock shoe arrangement, workers aboard containerized shipswill berelatively familiar with the operation of the lock shoe, and the stanchion may be portable and easily moved from place to place on the ship. Several stanchions will be used, and these may be spaced apart so that the ropes connected between the stanchions will provide reasonably large areas of security and safety for the workers. The stanchions may be kept in place until such time as the area in which they are located needs to be cleared in order to allow a container to be placed on the ships deck. In fact, the stanchions may also be kept in place while the container is being dropped into its proper location, and the lock shoe portion of the stanchion may be employed to lock the container while the stanchion remains in place. In this fashion, it is not required that the stanchion be removed from its location, and its dual function of serving as a lock shoe for locking the container to the deck as well as providing the portable stanchion may be simultaneously achieved.

Although the present invention utilizes the standard lock shoes described above, that lock shoe is shown in some detail in FIG. 3. The lock shoe comprises a manually operable locking member which comprises a set of plates 28 which are controlled by lever 18 to either lock the lock shoe and/or stanchion to the deck or be moved out from that locking position.

The above invention has been described with reference to a preferred embodiment. Modifications and improvementsof this invention may be made without departing from the spirit and scope of this invention.

What is claimed is:

1. A stanchion for use on ship decks handling container loads, said stanchion comprising a manually operable locking member comprising a pivotable foot lever pivotable about a vertical axis and a cylindrical base having a slot in which said foot lever is moved, said locking member moveable by said foot lever from a position locking said member to the deck to a position freeing the locking member from the deck, the base of the locking member bearing against said container to firmly hold containers on the dick of the ship, a rigid vertical cylindrical stanchion post integrally attached to said locking member, the diameter of said cylindrical stanchion post being smaller than the diameter of the cylindrical base of the locking member such that the stanchion can be grasped by a deckhand while a container firmly supported by the locking member, said vertical stanchion post further comprising rings for attaching safety ropes thereto, said locking member fixedly securing said stanchion in place on the deck of the ship whether or not a container is in place, said stanchion being of sufficient weight to be portable so as to be carried between locations on the deck and being of sufficient height to be grasped by a deckhand.

2. A portable stanchion as claimed in claim 1 wherein said stanchion is made of metal.

3. A stanchion as claimed in claim 1, wherein said locking member and said stanchion are formed as an integral one-piece unit.

* * * * *